US008406669B2

(12) United States Patent
Egusa et al.

(10) Patent No.: US 8,406,669 B2
(45) Date of Patent: Mar. 26, 2013

(54) FIXING DEVICE, FIXING METHOD, AND IMAGE FORMING APPARATUS FOR FIXING A TONER IMAGE USING A FIRST LASER UNIT AND A SECOND LASER UNIT

(75) Inventors: Naoyuki Egusa, Kanagawa (JP); Makoto Furuki, Kanagawa (JP); Tetsuro Kodera, Kanagawa (JP); Miho Watanabe, Kanagawa (JP); Takashi Matsubara, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 167 days.

(21) Appl. No.: 12/726,935

(22) Filed: Mar. 18, 2010

(65) Prior Publication Data

US 2011/0038653 A1 Feb. 17, 2011

(30) Foreign Application Priority Data

Aug. 11, 2009 (JP) ..... 2009-186495

(51) Int. Cl.
*G03G 15/20* (2006.01)

(52) U.S. Cl. ..... 399/335; 399/336

(58) Field of Classification Search ..... 399/335, 399/336

See application file for complete search history.

(56) References Cited

U.S. PATENT DOCUMENTS

| | | | |
|---|---|---|---|
| 5,448,344 | A | 9/1995 | Itakura et al. |
| 7,440,722 | B2 * | 10/2008 | Lofthus et al. |
| 2006/0133836 | A1 * | 6/2006 | Nakayama |

FOREIGN PATENT DOCUMENTS

| | | | |
|---|---|---|---|
| JP | 59-95567 | A | 6/1984 |
| JP | 6-308852 | A | 11/1994 |
| JP | 3016685 | B2 | 3/2000 |
| JP | 2005-128338 | A | 5/2005 |
| JP | 2006-171220 | A | 6/2006 |
| JP | 2007-57903 | A | 3/2007 |
| JP | 2008-89828 | A | 4/2008 |

OTHER PUBLICATIONS

Office Action, dated Jan. 15, 2013, issued by the Japanese Patent Office in counterpart Japanese Patent Application No. 2009-186495.

* cited by examiner

*Primary Examiner* — David Gray
*Assistant Examiner* — Laura Roth
(74) *Attorney, Agent, or Firm* — Sughrue Mion, PLLC

(57) ABSTRACT

According to an aspect of the invention, a fixing device includes a first laser unit and a second laser unit. The first laser unit outputs a first laser beam to irradiate a visible image formed of image forming material on a recording medium with the first laser beam. The second laser unit outputs a second laser beam to irradiate the visible image with the second laser beam after being irradiated with the first laser beam. The first laser beam and the second laser beam is configured to satisfy relations: W1<W2 and t1>t2, W1 is an optical output per unit area of the first laser beam, W2 is an optical output per unit area of the second laser beam, t1 is an irradiation time per unit area of the first laser beam, and t2 is an irradiation time per unit area of the second laser beam.

6 Claims, 9 Drawing Sheets

FIG. 14

| | FIXING PERFORMANCE OF IMAGE | | DEFECTIVE IMAGE |
|---|---|---|---|
| | HIGH IMAGE DENSITY AREA | LOW IMAGE DENSITY AREA | |
| EXAMPLE 1 | ○ | ○ | ○ |
| EXAMPLE 2 | ○ | ○ | ○ |
| EXAMPLE 3 | ○ | ○ | ○ |
| COMPARATIVE EXAMPLE 1 | ○ | × | ○ |
| COMPARATIVE EXAMPLE 2 | ○ | ○ | × |

FIXING DEVICE, FIXING METHOD, AND IMAGE FORMING APPARATUS FOR FIXING A TONER IMAGE USING A FIRST LASER UNIT AND A SECOND LASER UNIT

CROSS-REFERENCE TO RELATED APPLICATIONS

This application is based upon and claims priority under 35 USC 119 from Japanese Patent Application No. 2009-186495, filed Aug. 11, 2009.

BACKGROUND

Technical Field

The present invention relates to a fixing device, a fixing method, and an image forming apparatus.

SUMMARY OF THE INVENTION

According to an aspect of the invention, a fixing device includes a first laser unit and a second laser unit. The first laser unit outputs a first laser beam so as to irradiate a visible image formed of image forming material on a recording medium with the first laser beam. The second laser unit outputs a second laser beam so as to irradiate the visible image with the second laser beam after being irradiated with the first laser beam. The first laser beam and the second laser beam is configured to satisfy relations: W1<W2 and t1>t2, W1 is an optical output per unit area of the first laser beam, W2 is an optical output per unit area of the second laser beam, t1 is an irradiation time per unit area of the first laser beam, t2 is an irradiation time per unit area of the second laser beam, and the visible image is fixed on the recording medium by the first laser beam and the second laser beam with the relations.

BRIEF DESCRIPTION OF THE DRAWINGS

Exemplary embodiments of the invention will be described in detail based on the following figures, wherein:

FIG. 1A is a side view as seen in a direction intersecting a conveying direction of a recording medium, and FIG. 1B is a front view as seen in a direction along the conveying direction of the recording medium;

FIG. 14 is a table showing results of evaluation on fixing performance of an image (a toner image) with respect to the recording medium, which were obtained by comparing examples with comparative examples.

DETAILED DESCRIPTION (Summary of Exemplary Embodiments)

Figure 1A:
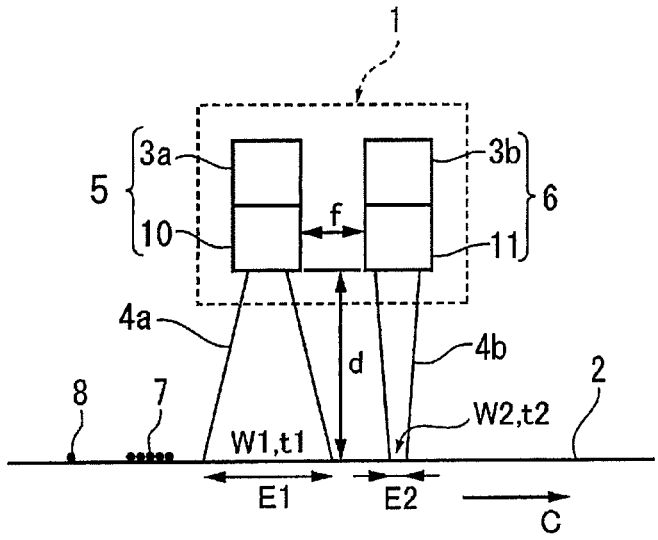
FIGS. 1A and 1B are explanatory views each showing a schematic structure of a fixing device in an exemplary embodiment according to the invention.
Figure 1B:
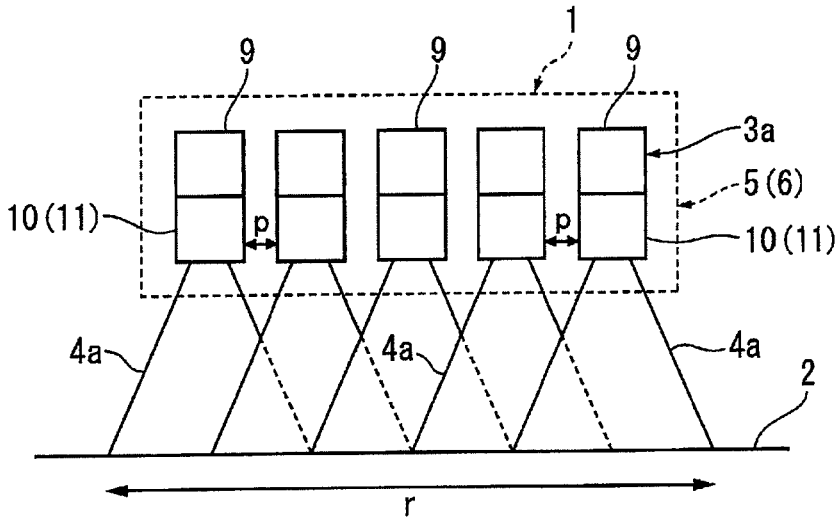

FIGS. 1A and 1B are explanatory views each showing a schematic structure of a fixing device in an exemplary embodiment according to the invention. FIG. 1A is a side view as seen from a direction intersecting a conveying direction of a recording medium, and FIG. 1B is a front view as seen in a direction along the conveying direction of the recording medium.

A fixing device 1 in this exemplary embodiment includes a first laser beam radiating part 5 which is provided at a predetermined distance d from a surface of a recording medium (recording paper, for example) 2 which is conveyed in a predetermined direction (an arrow mark C), and irradiates an expanded area E1 which is expanded by a predetermined amount upstream and downstream in the conveying direction C of the recording medium 2 with a laser beam 4*a* emitted from a laser beam source 3*a*, and a second laser beam radiating part 6 which is positioned at a downstream side of the first laser beam radiating part 5 in the conveying direction C of the recording medium 2, and irradiates a reduced area E2 which is more reduced than the expanded area E1 in the conveying direction C of the recording medium 2 with a laser beam 4*b* emitted from a laser beam source 3*b* which may be the same as the laser beam source 3*a* or different from the laser beam source 3*a*. Visible images 7, 8 formed of image forming material (hereinafter referred to as "toner images") which have been formed on the recording medium 2 are irradiated with the laser beams 4*a*, 4*b* from the first laser beam radiating part 5 and the second laser beam radiating part 6 thereby to fix the toner images on the recording medium 2. On this occasion, the irradiation with the laser beams 4*a*, 4*b* is conducted by satisfying the following condition $$W1<W2,\ t1>t2$$

(herein, W1 is an optical output per unit area of the laser beam 4*a* which is radiated from the first laser beam radiating part 5, W2 is an optical output per unit area of the laser beam 4*b* which is radiated from the second laser beam radiating part 6, t1 is an irradiation time per unit area of the laser beam 4*a* which is radiated from the first laser beam radiating part 5, and t2 is an irradiation time per unit area of the laser beam 4*b* which is radiated from the second laser beam radiating part 6).

In the exemplary embodiment as described above, the first laser beam radiating part 5 diffuses the laser beam 4*a* which is emitted from the one laser beam source 3*a* to irradiate the expanded area E1 which is expanded by a predetermined amount upstream and downstream in the conveying direction C of the recording medium 2, and is disposed apart from the surface of the recording medium 2 by the predetermined distance d.

The second laser beam radiating part 6 focuses the laser beam 4*b* which is emitted from the other laser beam source 3*b* to irradiate the reduced area E2 which is more reduced than the expanded area E1 in the conveying direction C of the recording medium 2. The second laser beam radiating part 6 is disposed apart from the surface of the recording medium 2 by the predetermined distance d, and positioned downstream from the first laser beam radiating part 5 in the conveying direction C of the recording medium 2.

The toner images 7, 8 which have been formed on the recording medium 2 are irradiated with the laser beams 4*a*, 4*b* from the first laser beam radiating part 5 and the second laser beam radiating part 6, whereby the toner images are fixed on the recording medium 2. On this occasion, the irradiation with the laser beams 4*a*, 4*b* is conducted by satisfying the condition $W1<W2$, $t1>t2$, provided that W1 is the optical output per unit area of the laser beam 4*a* which is radiated from the first laser beam radiating part 5, W2 is the optical output per unit area of the laser beam 4*b* which is radiated from the second laser beam radiating part 6, t1 is the irradiation time per unit area of the laser beam 4*a* which is radiated from the first laser beam radiating part 5, and t2 is the irradiation time per unit area of the laser beam 4*b* which is radiated from the second laser beam radiating part 6.

Herein, in FIG. 1A, the toner image 7 is an unfixed toner image which has been transferred to an area having high image density (hereinafter referred to as "the toner image having the high image density), and the toner image 8 is an unfixed toner image which has been transferred to an area having low image density (hereinafter referred to as "the toner image having the low image density). The toner image having the high image density means the toner image in a state where a number of toner particles are coagulated, as represented by a solid image, and the toner image having the low image density means a toner image in a state where only one or a few toner particles are present together, as represented by a character containing part or a half tone image. Moreover, a state where an isolated toner particle which is generated by a fog (a phenomenon that the toner adheres to a vacant area, to which the toner should not adhere essentially, through developing operation) or so adheres to the recording medium is also included in the toner image having the low image density.

When the recording medium 2 is conveyed in the direction of the arrow mark C, the toner image 7 having the high image density is irradiated with the laser beam 4*a* which has been diffused by the first laser beam radiating part 5 at the optical output W1 and for the irradiation time t1, whereby the toner particles are fused with the energy of $W1 \times t1 = J1$, and the toner image 7 having the high image density is fixed. On this occasion, the optical output W1 and the irradiation time t1 are so set that the toner particles can be fused with the output (W1) in the area having the high image density such as a colored solid image, taking the predetermined period of time (t1). In this state, even though the toner image 8 having the low image density continuously enters in the irradiation area of the laser beam 4*a*, the toner image 8 is unlikely to be fixed. This is because in the toner image having the low image density containing only one or a few toner particles, an amount of heat radiation is increased due to a large contact area between individual toner particles and air, and the toner particles will not be fused with the optical output W1.

Thereafter, the recording medium 2 is further conveyed in the direction of the arrow mark C, and the toner image 8 having the low image density enters into the irradiation area of the laser beam 4*b* from the second laser beam radiating part 6, to be irradiated with the laser beam 4*b* which has been focused by the second laser beam radiating part 6 with the optical output W2 and for the irradiation time t2, whereby the toner particles are fused with the energy of $W2 \times t2 = J2$, and the toner image 8 having the low image density is fixed. In this case, the laser beam 4*b* from the second laser beam radiating part 6 can fix the toner image 8 having the low image density, even though radiation of heat occurs, because the toner image 8 is irradiated with the laser beam 4*b* having a larger optical intensity than the laser beam 4*a* from the first laser beam radiating part 5 ($W2>W1$) for a shorter period ($t2<t1$).

In this manner, the unfixed toner image is fixed on the recording medium 2, in both the area having the high image density and the area having the low image density in the image which has been formed on the recording medium 2.

Moreover, in FIG. 1B, the laser beam source 3*a* of the first laser beam radiating part 5 includes a plurality of laser beam generating elements 9, 9, . . . which are arranged in a row at a predetermined interval p along a lateral direction r (a lateral direction of the recording paper, for example) intersecting the conveying direction C of the recording medium (See FIG. 1A). In this case, in an area of the recording medium 2 to be irradiated with the laser beams 4*a* from the respective laser beam generating elements 9, it is required that a part which is not irradiated with the laser beam may not occur at least in the area where the image can be formed in the lateral direction r. For this reason, the laser beams are so arranged as to be overlapped on each other between the adjacent elements 9, in this exemplary embodiment. Although not shown in FIG. 1B, the laser beam source 3*b* of the laser beam radiating part 6 has the same structure as described above.

Further, in FIGS. 1A and 1B, slits having elongated cutouts extending in a straight line may be formed in respective laser discharging parts of the first laser beam radiating part 5 and the second laser beam irradiating part 6, so that the first laser beam and the second laser beam extending in a straight line may be radiated through these slits.

Then, other exemplary embodiments of the first laser beam radiating part 5 and the second laser beam radiating part 6 will be described.

In FIG. 1A, the first laser beam radiating part 5 includes the one laser beam source 3*a* and a optical flux diffusing member 10 for diffusing the laser beam 4*a* from the laser beam source 3*a*, and the second laser beam radiating part 6 includes the other laser beam source 3*b* and a optical flux focusing member 11 for focusing the laser beam 4*b* from the laser beam source 3*b*. The first laser beam radiating part 5 and the second laser beam radiating part 6 are arranged upstream and downstream in the conveying direction C of the recording medium 2 interposing a predetermined interval f. According to this exemplary embodiment, the first laser beam and the second laser beam are radiated upstream and downstream in the conveying direction C of the recording medium 2, interposing a predetermined interval.

Moreover, the first laser beam radiating part 5 and the second laser beam radiating part 6 may includes one common laser beam source, the optical flux diffusing member 10 for diffusing the laser beam which is present at the upstream side in the conveying direction C of the recording medium 2 or the laser beam diverged to the upstream side out of the laser beams from the laser beam source, and the optical flux focusing member 11 for focusing the laser beam which is present at the downstream side in the conveying direction C of the recording medium 2 or the laser beam diverged to the downstream side out of the laser beams from the laser beam source. Further, the first laser beam radiating part 5 and the second laser beam radiating part 6 may be arranged adjacent to each other upstream and downstream in the conveying direction C of the recording medium 2. According to this exemplary embodiment, the first laser beam and the second laser beam are radiated adjacent to each other upstream and downstream in the conveying direction C of the recording medium 2.

Further, an optical axis of the laser beam emitted from the laser beam source may be inclined at a predetermined angle (for example, from 40 to 50 degree, preferably 45 degree) toward the upstream side in the conveying direction C of the recording medium 2, so that the laser beam which is present at the upstream side in the conveying direction C of the recording medium 2 out of the laser beams from the laser beam source may be radiated to the expanded area E1 in the conveying direction C, while the laser beam which is present at the downstream side in the conveying direction C of the recording medium 2 may be radiated to the reduced area E2 which is more reduced than the expanded area E1. According to this exemplary embodiment, the first laser beam and the second laser beam are radiated to the areas which are continued from the upstream side to the downstream side in the conveying direction C of the recording medium 2.

Still further, the fixing device may be provided with an optical flux adjusting member, as an optical system for once focusing and then, diffusing the laser beam from the laser beam source, and the optical axis of the laser beam emitted from the laser beam source may be inclined at a predetermined angle (for example, from 40 to 50 degree, preferably 45 degree) toward the upstream side in the conveying direction C of the recording medium 2, so that the laser beam which is present at the upstream side in the conveying direction C of the recording medium 2 out of the laser beams from the laser beam source may be radiated to the expanded area E1 in the conveying direction C, while the laser beam which is present at the downstream side in the conveying direction C of the recording medium 2 may be radiated to the reduced area E2 which is more reduced than the expanded area E1. According to this exemplary embodiment, the first laser beam and the second laser beam are radiated to the areas which are continued from the upstream side to the downstream side in the conveying direction C of the recording medium 2, in a state where the laser beam has been once focused and then diffused by means of the optical flux adjusting member.

An image forming apparatus to which the fixing device according to the exemplary embodiments is applied includes an image forming section for forming the toner image on the recording medium 2, and the fixing device 1 in the above described exemplary embodiments for fixing the toner image which has been formed by the image forming section to the recording medium 2.

Now, the exemplary embodiments according to the invention will be described in detail referring to the attached drawings.

(First Exemplary Embodiment)

Figure 2:
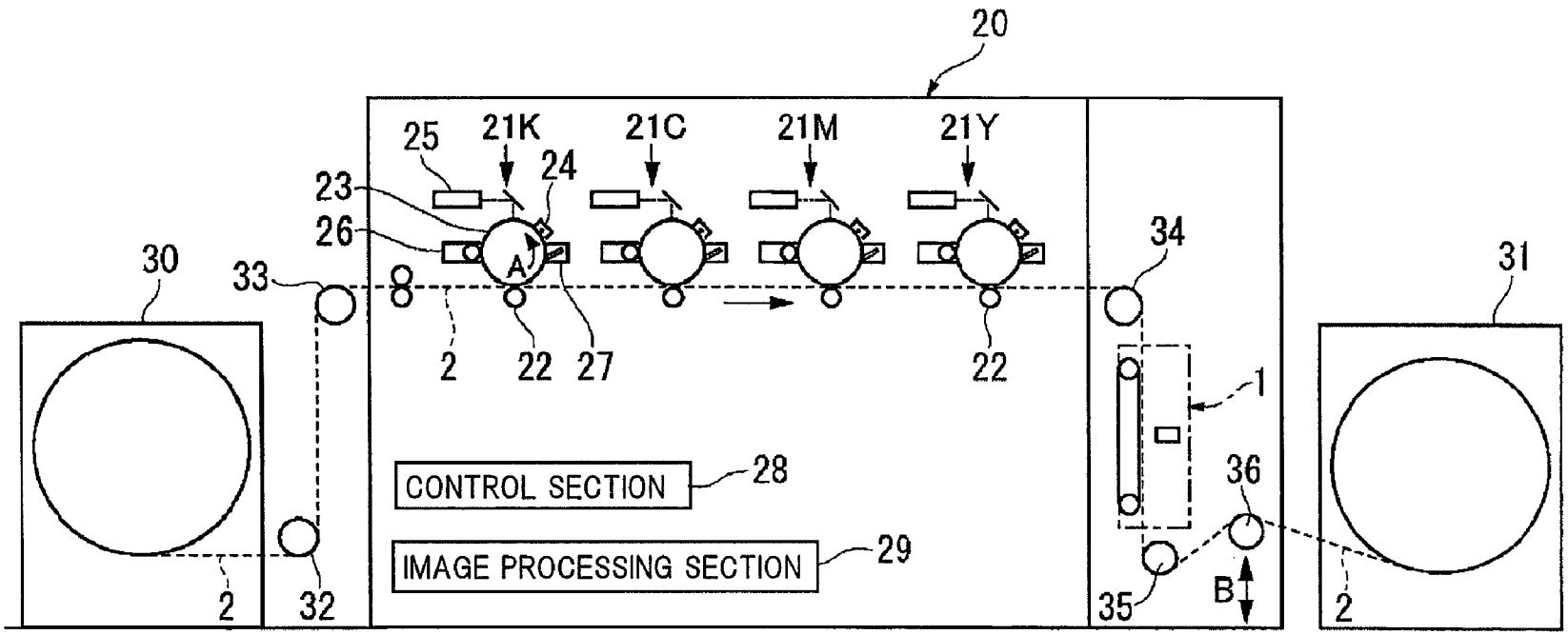
FIG. 2 is an explanatory view showing an entire structure of an image forming apparatus in a first exemplary embodiment, to which the fixing device is applied.

FIG. 2 is an explanatory view showing an entire structure of the image forming apparatus in a first exemplary embodiment, to which the fixing device according to the exemplary embodiment is applied. This image forming apparatus 20 is intended to form a toner image which is a visible image on a recording medium, to transfer thus formed toner image to the recording medium, and to fix this transferred toner image on the recording medium. The image forming apparatus 20 includes an image forming section 21, transferring devices 22, and the fixing device 1.

The image forming section 21 forms the toner image on the recording medium 2 such as recording paper according to an electro-photographic system, for example, and includes image forming parts of four colors, for example, so that the image can be expressed in full color. Specifically, the image forming section 21 includes a black image forming part 21K, a cyan image forming part 21C, a magenta image forming part 21M, and an yellow image forming part 21Y. The image forming parts 21K, 21C, 21M, 21Y of the respective colors have the same structure except that they are different in color of the toner to be used. As a representative example, the black image forming part 21K will be described below.

This black image forming part 21K is provided with a photosensitive body 23 in a cylindrical shape having a photosensitive layer, which is not shown, on its surface, and can be rotated in a direction of an arrow mark A. An electrifying device 24, an exposing device 25, and a developing device 26 are provided around this photosensitive body 23. The electrifying device 24 electrifies the photosensitive layer of the photosensitive body 23 to a predetermined electric potential. The exposing device 25 is provided with a laser beam source, which is not shown, and selectively radiates a laser beam to the photosensitive layer of the photosensitive body 23 which has been electrified to the predetermined electric potential by the electrifying device 24 thereby to form an electrostatic latent image. The developing device 26 contains the toner of the corresponding color component (black, in this case) and visualizes the electrostatic latent image on the photosensitive layer of the photosensitive body 23 with this toner.

The transferring devices 22 transfer the toner images formed in the image forming parts 21K, 21C, 21M, 21Y of the respective colors to the recording medium 2. Each of the transferring devices 22 is provided with a transferring member in a cylindrical or columnar shape which is disposed in contact with a surface of the photosensitive body 23 so as to be rotated in a state pressed against the photosensitive body 23. The toner image on the photosensitive body 23 is transferred to the recording medium 2, by applying a transfer bias between the transferring member and the photosensitive body 23.

Further, a photosensitive body cleaning unit 27 is provided around the photosensitive body 23. This photosensitive body cleaning unit 27 removes residual toner which adheres to the photosensitive body 23, after the toner image has been transferred to the recording medium 2 by the transferring device 22.

Moreover, in FIG. 2, a control section 28 controls the image forming parts 21K, 21C, 21M, 21Y of the respective colors, the transferring devices 22, and the fixing device 1 which will be described below. Further, an image processing section 29 performs a process for forming an image on the recording medium 2.

In the exemplary embodiment in FIG. 2, a continuous recording paper which has been wound around a core member or a continuous recording paper which has been folded to a predetermined size is used as the recording medium 2. Specifically, the recording medium 2 is loaded in a paper supplying device 30 which is installed outside the image forming apparatus 20, and taken up by a paper take up device 31 which is also installed outside the image forming apparatus 20. The continuous recording paper supplied from the paper supplying device 30 is conveyed to the image forming parts 21K, 21C, 21M, 21Y of the respective colors, and the toner image is transferred in order of black, cyan, magenta, and yellow. Thereafter, the recording paper is conveyed to the fixing device 1, where the toner image is fixed with irradiation of the laser beam, and then, the recording paper is taken up by the paper take up device 31 outside the apparatus.

The continuous recording paper is adjusted in position by means of a plurality of position adjusting rolls 32, 33, 34, which are provided in a passage where the continuous recording paper passes, so that the continuous recording paper may not be displaced while it is conveyed. Positional adjustment of this continuous recording paper is a step to be carried out before the image is transferred to the recording medium 2. A tension applying roll 36 at the final stage is supported by an urging member, which is not shown, so as to move in a direction of an arrow mark B, so that a tension of a predetermined strength may be applied to the recording paper while it is conveyed. The continuous recording paper is adjusted in position by this tension applying roll 36 to be taken up without a breakage.

Now, a specific structure of the fixing device 1 for fixing the toner image which has been transferred by the transferring device 22 as shown in FIG. 2 on the recording medium 2 will be described referring to FIGS. 3 to 7.

Figure 3:
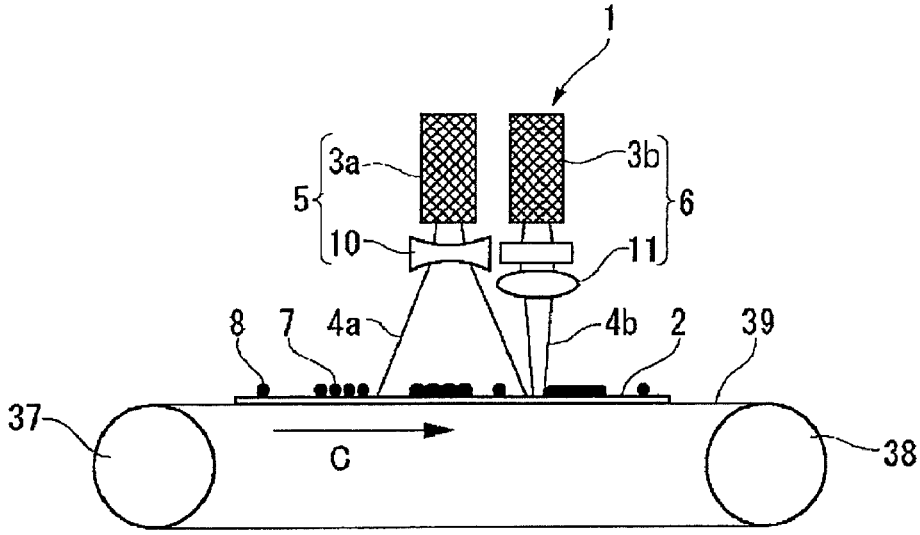
FIG. 3 is an explanatory view showing the fixing device in a first exemplary embodiment, as seen in the direction intersecting the conveying direction of the recording medium.

In FIG. 3, the fixing device 1 according to the first exemplary embodiment includes the first laser beam radiating part 5 and the second laser beam radiating part 6. The first laser beam radiating part 5 includes the first laser beam source 3*a*, and the optical flux diffusing member 10 (for example, a concave lens) for diffusing the laser beam from the laser beam source 3*a*. The first laser beam radiating part 5 irradiates the expanded area E1 in the conveying direction C of the recording medium 2 (See FIG. 1A), by diffusing the laser beam 4*a* which is radiated from the laser beam radiating part 5, and is disposed apart from the surface of the recording medium 2 which is conveyed in the direction of the arrow mark C, by the distance d (See FIG. 1A).

The second laser beam radiating part 6 includes the second laser beam source 3*b* and the optical flux focusing member 11 (for example, a convex lens) for focusing the laser beam from the laser beam source 3*b*. The second laser beam radiating part 6 irradiates the reduced area E2 which is more reduced than the expanded area E1 in the conveying direction C of the recording medium 2 (See FIG. 1A), by focusing the laser beam 4*b* which is radiated from the laser beam radiating part 6. The second laser beam radiating part 6 is disposed apart from the surface of the recording medium 2 by the distance d, and positioned at the downstream side of the first laser beam radiating part 5 at an interval of f in the conveying direction C (See FIG. 1A).

The recording medium 2 is conveyed by a conveying mechanism including a first conveying roll 37, a second conveying roll 38, and a conveying belt 39 stretched between the two conveying rolls 37, 38, in the direction of the arrow mark C in a state placed on the conveying belt 39.

Figure 4:
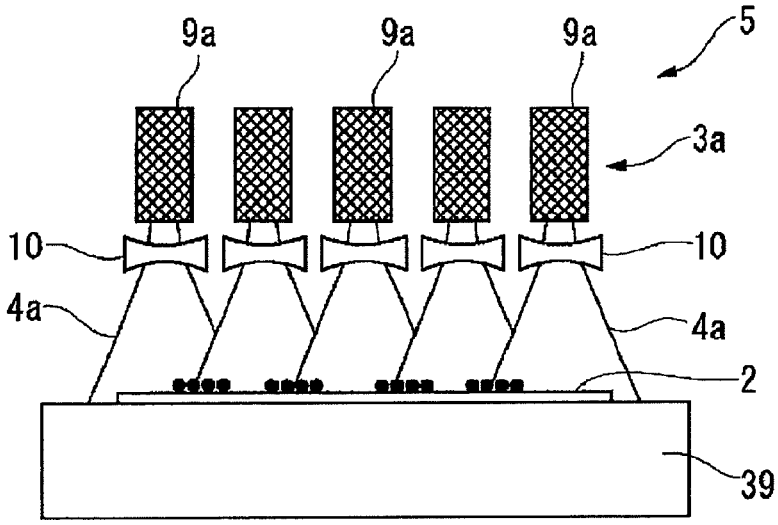
FIG. 4 is an explanatory view showing a first laser beam radiating part in the fixing device, and a front view as seen in the direction along the conveying direction of the recording medium.
Figure 5:
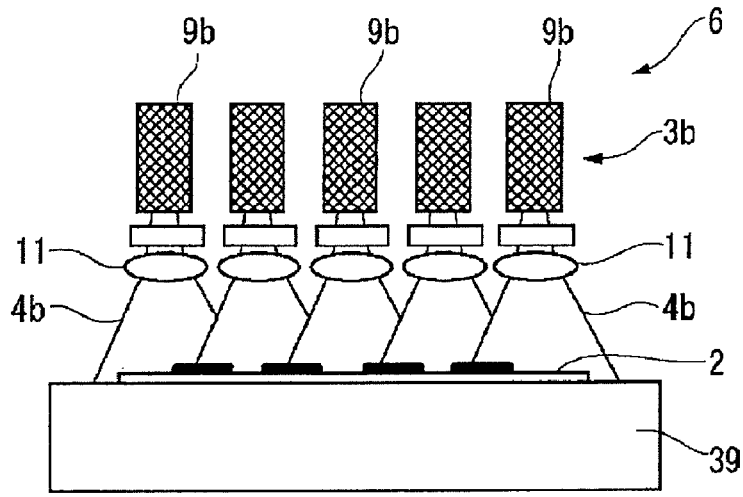
FIG. 5 is an explanatory view showing a second laser beam radiating part in the fixing device, and a front view as seen in the direction along the conveying direction of the recording medium.
Figure 6:
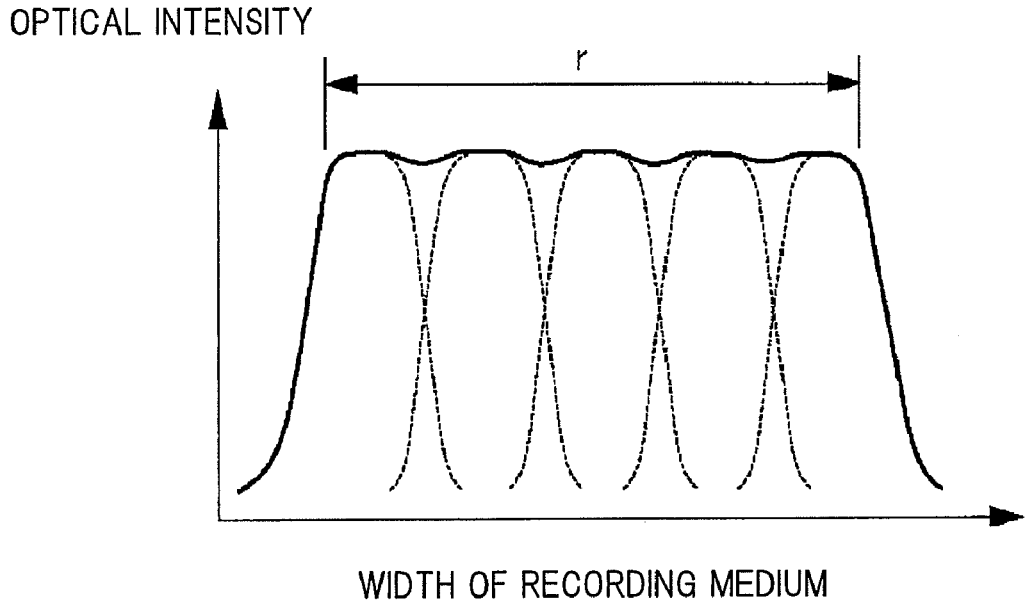
FIG. 6 is a graph showing optical intensities of the laser beams which are radiated from the first and second laser beam radiating parts in a lateral direction intersecting the conveying direction of the recording medium.

As shown in FIGS. 4 and 5, the laser beam sources 3*a*, 3*b* of the first and second laser beam radiating parts 5, 6 are respectively provided with a plurality of laser beam emitting elements 9*a*, 9*b* which are arranged in a row at an interval p along the lateral direction r intersecting the conveying direction C of the recording medium 2 (See FIG. 1B: a direction of a width of the recording paper, for example), so that an entire width of the recording medium 2 may be irradiated with the laser beams 4*a*, 4*b*. On this occasion, optical intensities of the laser beams radiated from the first and second laser beam radiating parts 5, 6 are so set as to be substantially constant in the lateral direction r of the recording medium 2, as shown in FIG. 6.

Now, operation of the fixing device 1 having the above described structure will be described. In FIG. 3, the recording medium 2 which has been conveyed to the fixing device 1 from the transferring device 22, which is not illustrated in FIG. 3, is conveyed by the conveying belt 39 in the direction of the arrow mark C, and the laser beams 4*a*, 4*b* are sequentially radiated in order from the first laser beam radiating part 5 and the second laser beam radiating part 6 to the toner image 7 having the high image density and the toner image 8 having the low image density which have been transferred to the recording medium 2. In this case, the laser beam from the laser beam source 3*a* of the first laser beam radiating part 5 is diffused by the optical flux diffusing member 10 to irradiate the recording medium 2. The optical output per unit area of this laser beam is W1, and the irradiation time per unit area of this laser beam is t1. Moreover, the laser beam from the laser beam source 3*b* of the second laser beam radiating part 6 is focused by the optical flux focusing member 11 to irradiate the recording medium 2. The optical output per unit area of this laser beam is W2, and the irradiation time per unit area of this laser beam is t2. On this occasion, the laser beams 4*a*, 4*b* are radiated by satisfying the condition W1<W2, t1>t2.

Figure 7:
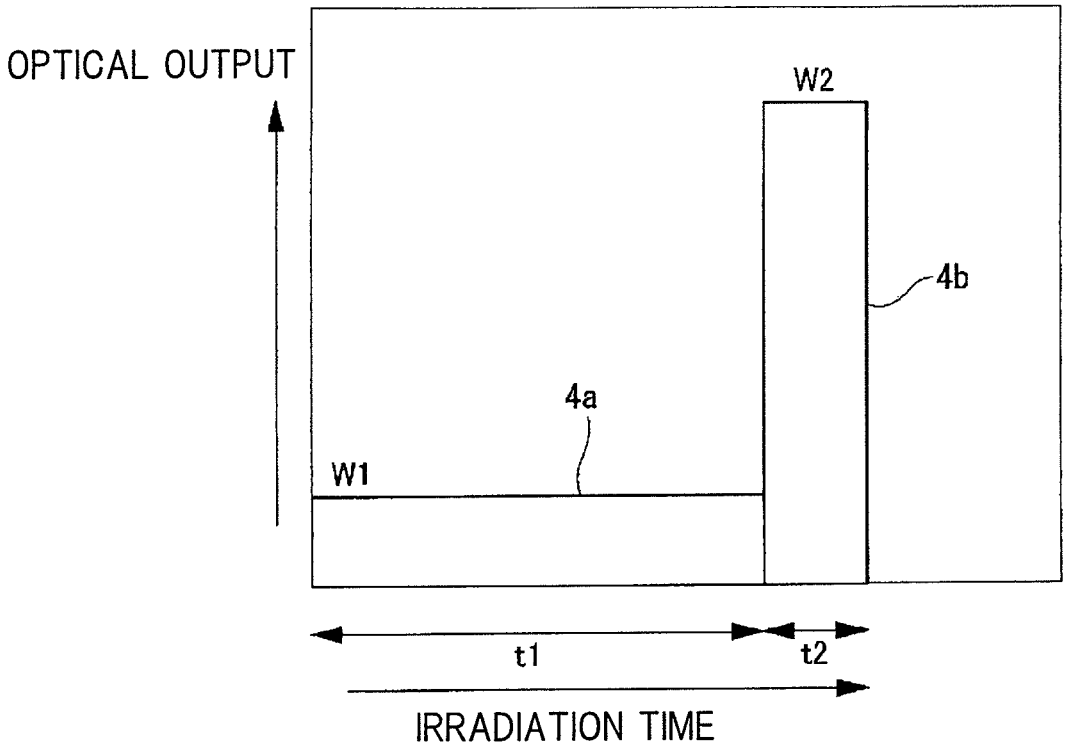
FIG. 7 is a graph showing relation between optical outputs of the laser beams which are radiated from the first and second laser beam radiating parts, and irradiation times.

The optical outputs of the laser beams 4*a*, 4*b* emitted from the first and second laser beam radiating parts 5, 6 with respect to the irradiation time are shown in a graph in FIG. 7. Specifically, the first laser beam radiating part 5 radiates the laser beam 4*a* which is smaller than the laser beam from the second laser beam radiating part 6 (W1<W2) for a longer time than the second laser beam radiating part 6 (t1>t2), and fixes the toner image 7 having the high image density on the recording medium 2 with the energy of W1×t1=J1. Moreover, the second laser beam radiating part 6 radiates the laser beam 4*b* which is larger than the laser beam from the first laser beam radiating part 5 (W2>W1) for a shorter time than the first laser beam radiating part 5 (t2<t1), and fixes the toner image 8 having the low image density on the recording medium 2 with the energy of W2×t2=J2. In this manner, the first laser beam radiating part 5 is mounted for the purpose of fixing the toner image 7 having the high image density out of the toner images which have been formed on the recording medium 2, while the second laser beam radiating part 6 is mounted for the purpose of fixing the toner image 8 having the low image density such as the halftone image or an isolated toner.

In the fixing device using a light from a conventional incandescent lamp or a laser beam source, the toner image 8 having the low image density is hard to be fixed, even though it is irradiated with the light, because of a large heat radiation due to a large contact area with the air. In case where this toner image 8 having the low image density is present on the recording medium 2 in an unfixed state, there is a case that components inside the apparatus, particularly the components in the mechanism for conveying the recording medium 2 may be soiled in a course of moving inside the apparatus in downstream of the fixing device 1 in the conveying direction. However, this exemplary embodiment may prevent such soiling.

Moreover, it is possible to control irradiation with the laser beams 4*a*, 4*b* from the first laser beam radiating part 5 and the second laser beam radiating part 6 by control means, depending on a difference between an area where an image is formed and an area where an image should not be formed on the recording medium 2. For example, the difference between the areas on the recording medium 2 is judged by the control means, on the basis of a conveying speed at which the conveying mechanism conveys the recording medium 2, and pixel values contained in image data of the image to be formed on the recording medium 2, and also, the position of the recording medium 2 passing through a laser beam irradiation range of the first and second laser beam radiating parts 5, 6 is specified by the control means. Then, on the basis of the positional information thus specified, the irradiation may be controlled so that the area where the image is formed may be irradiated with the laser beams 4*a*, 4*b* from both the first and second laser beam radiating parts 5, 6, while the area where the image should not be formed may be irradiated with the laser beam 4*b* only from the second laser beam radiating part 6.

(Second Exemplary Embodiment)

Figure 8:
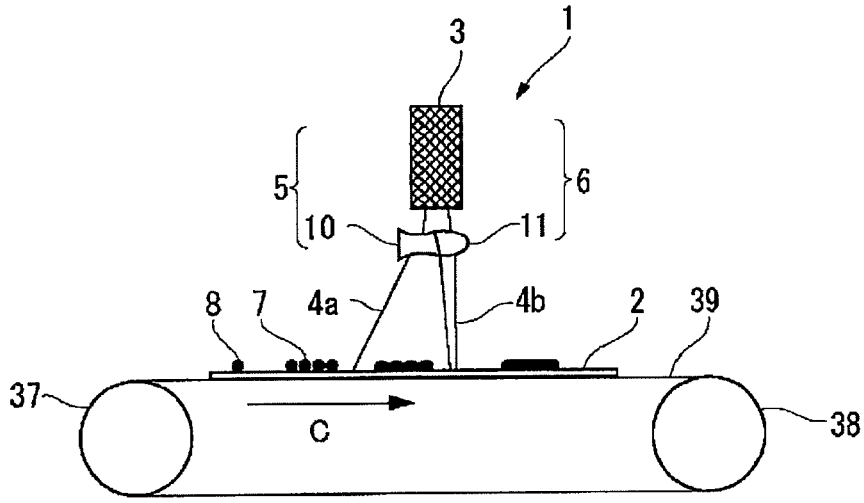
FIG. 8 is an explanatory view showing the fixing device in a second exemplary embodiment, as seen in the direction intersecting the conveying direction of the recording medium.

FIG. 8 is a side view for explaining the fixing device in a second exemplary embodiment, as seen in the direction intersecting the conveying direction C of the recording medium 2. The fixing device 1 in this exemplary embodiment includes one common laser beam source 3, the optical flux diffusing member 10 (for example, a concave lens) for diffusing the laser beam 4*a* which is present at the upstream side in the conveying direction C of the recording medium 2 out of the laser beams from the laser beam source 3, and the optical flux focusing member 11 (for example, a convex lens) for focusing the laser beam 4*b* which is present at the downstream side in the conveying direction C of the recording medium 2 out of the laser beams from the laser beam source 3. In this exemplary embodiment, the optical flux diffusing member 10 and the optical flux focusing member 11 are formed into a special lens which is obtained, for example, by combining a concave lens and a convex lens which are juxtaposed upstream and downstream in the conveying direction C of the recording medium 2. The first laser beam radiating part 5 is composed of the laser beam source 3 and the optical flux diffusing member 10, while the second laser beam radiating part 6 is composed of the laser beam source 3 and the optical flux focusing member 11. In this manner, the first laser beam radiating part 5 and the second laser beam radiating part 6 are arranged adjacent to each other upstream and downstream in the conveying direction C of the recording medium 2.

In case of this second exemplary embodiment, the one laser beam source 3 which is common to both the first laser beam radiating part 5 and the second laser beam radiating part 6 is so designed as to emit a beam having an optical intensity of twice as large as the case of the first exemplary embodiment as shown in FIG. 3.

(Third Exemplary Embodiment)

Figure 9:
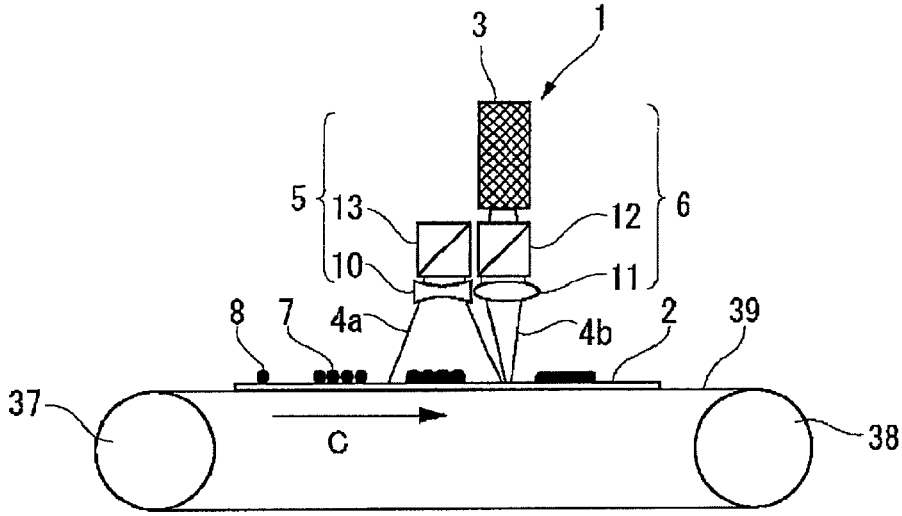
FIG. 9 is an explanatory view showing the fixing device in a third exemplary embodiment, as seen in the direction intersecting the conveying direction of the recording medium.

FIG. 9 is a side view for explaining the fixing device in a third exemplary embodiment, as seen in the direction intersecting the conveying direction C of the recording medium 2. The fixing device 1 in this exemplary embodiment includes one common laser beam source 3, a half mirror 12 for dividing the laser beam from the laser beam source 3 in two by penetrating a part of the laser beam and reflecting the other part of the laser beam sideward, a total reflection mirror 13 for further reflecting the laser beam which has been reflected by the half mirror thereby to direct an optical path to the recording medium 2, the optical flux diffusing member 10 (for example, a concave lens) for diffusing the laser beam which has been reflected by the total reflection mirror 13, and the optical flux focusing member 11 (for example, a convex lens) for focusing the laser beam 4*b* which has penetrated the half mirror 12. In this exemplary embodiment, the half mirror 12 and the total reflection mirror 13 are arranged adjacent to each other upstream and downstream in the conveying direction C of the recording medium 2. The first laser beam radiating part 5 is composed of the laser beam source 3, the half mirror 12, the total reflection mirror 13, and the optical flux diffusing member 11, whereby the recording medium 2 is irradiated with the laser beam 4*a* from the first laser beam radiating part 5. On the other hand, the second laser beam radiating part 6 is composed of the laser beam source 3, the half mirror 12, and the optical flux focusing member 11, whereby the recording medium 2 is irradiated with the laser beam 4*b* from the second laser beam radiating part 6. In this exemplary embodiment, the first laser beam radiating part 5 and the second laser beam radiating part 6 are arranged adjacent to each other upstream and downstream in the conveying direction C of the recording medium 2.

In case of this third exemplary embodiment too, the one laser beam source 3 which is common to both the first laser beam radiating part 5 and the second laser beam radiating part 6 is so designed as to emit a beam having an optical intensity of twice as large as the case of the first exemplary embodiment as shown in FIG. 3.

Moreover, in the exemplary embodiments as shown in FIGS. 8 and 9, relation between the optical outputs of the laser beams 4*a*, 4*b* which are radiated from the first laser beam radiating part 5 and the second laser beam radiating part 6 and the irradiation time is the same as in the graph in FIG. 7.

(Fourth Exemplary Embodiment)

Figure 10:
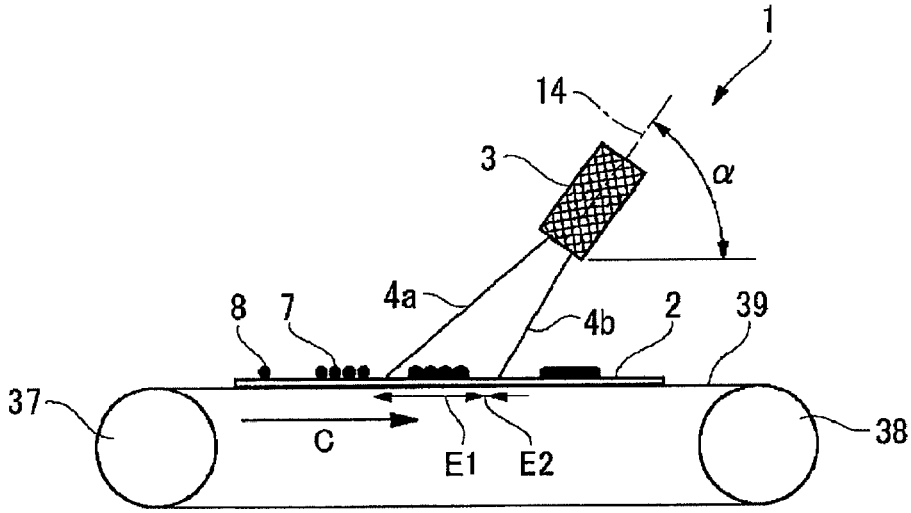
FIG. 10 is an explanatory view showing the fixing device in a fourth exemplary embodiment, as seen in the direction intersecting the conveying direction of the recording medium.

FIG. 10 is a side view for explaining the fixing device in a fourth exemplary embodiment, as seen in the direction intersecting the conveying direction C of the recording medium 2. The fixing device 1 in this exemplary embodiment includes one common laser beam source 3, and an optical axis 14 of the laser beam which is emitted from the laser beam source 3 is inclined at a predetermined angle $\alpha$ (in a range from 40 to 50 degree, preferably 45 degree) to the downstream side in the conveying direction C of the recording medium 2. In this case, the first laser beam radiating part 5 and the second laser beam radiating part 6 are composed of the one laser beam source 3 of which the optical axis 14 of the laser beam is inclined at the predetermined angle $\alpha$ to the downstream side in the conveying direction C of the recording medium 2. Then, the expanded area E1 which is expanded upstream and downstream in the conveying direction C is irradiated with the laser beam 4*a* which is present at the upstream side in the conveying direction C of the recording medium 2 out of the laser beams from the laser beam source 3, and the reduced area E2 which is more reduced than the expanded area E1 in the conveying direction C is irradiated with the laser beam 4*b* which is present at the downstream side in the conveying direction C of the recording medium 2.

In this exemplary embodiment, E1 is the area where the toner image having the high image density can be fixed, and it is so set that an average optical output of the laser beam 4*a* which irradiates the expanded area E1 is W1, and an irradiation time of the same is t1. Moreover, E2 is the area where the toner image having the low image density can be fixed, and it is so set that an average optical output of the laser beam 4*b* which irradiates the expanded area E2 is W2, and an irradiation time of the same is t2.

In case of this fourth exemplary embodiment too, the one laser beam source 3 is so designed as to emit a beam having an optical intensity of twice as large as the case of the first exemplary embodiment as shown in FIG. 3.

(Fifth Exemplary Embodiment)

Figure 11:
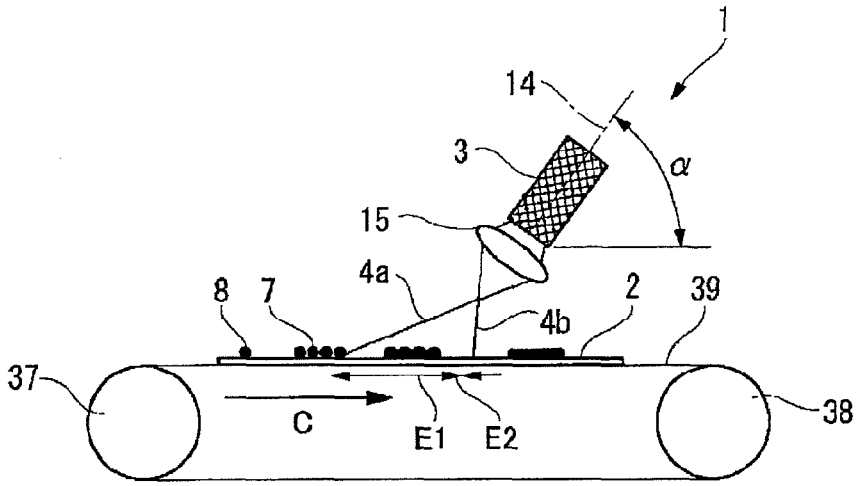
FIG. 11 is an explanatory view showing the fixing device in a fifth exemplary embodiment, as seen in the direction intersecting the conveying direction of the recording medium.

FIG. 11 is a side view for explaining the fixing device in a fifth exemplary embodiment, as seen in a direction intersecting the conveying direction C of the recording medium 2. The fixing device 1 in this exemplary embodiment includes one common laser beam source 3, and an optical flux adjusting member (for example, a converging lens) 15 as an optical system for once focusing the laser beam from the laser beam source 3 and then diffusing the laser beam. The optical axis of the laser beam which is emitted from the laser beam source 3 is inclined at a predetermined angle α (in a range from 40 to 50 degree, preferably 45 degree) to the downstream side in the conveying direction C of the recording medium 2. In this case, the first laser beam radiating part 5 and the second laser beam radiating part 6 are composed of the one laser beam source 3 of which the optical axis 14 of the laser beam is inclined at the predetermined angle α to the downstream side in the conveying direction C of the recording medium 2. Then, the expanded area E1 which is expanded upstream and downstream in the conveying direction C is irradiated with the laser beam 4*a* which is present at the upstream side in the conveying direction C of the recording medium 2 out of the laser beams emitted from the laser beam source 3 and the optical flux adjusting member 15, while the reduced area E2 which is more reduced than the expanded area E1 in the conveying direction C is irradiated with the laser beam 4*b* which is present at the downstream side in the conveying direction C of the recording medium 2.

In this exemplary embodiment, E1 is the area where the toner image having the high image density can be fixed, and it is so set that an average optical output of the laser beam 4*a* which irradiates the expanded area E1 is W1, and an irradiation time of the same is t1. Moreover, E2 is the area where the toner image having the low image density can be fixed, and it is so set that an average optical output of the laser beam 4*b* which irradiates the expanded area E2 is W2, and an irradiation time of the same is t2.

In case of this fifth exemplary embodiment too, the one laser beam source 3 is so designed as to emit a beam having an optical intensity of twice as large as the case of the first exemplary embodiment as shown in FIG. 3.

Figure 12:
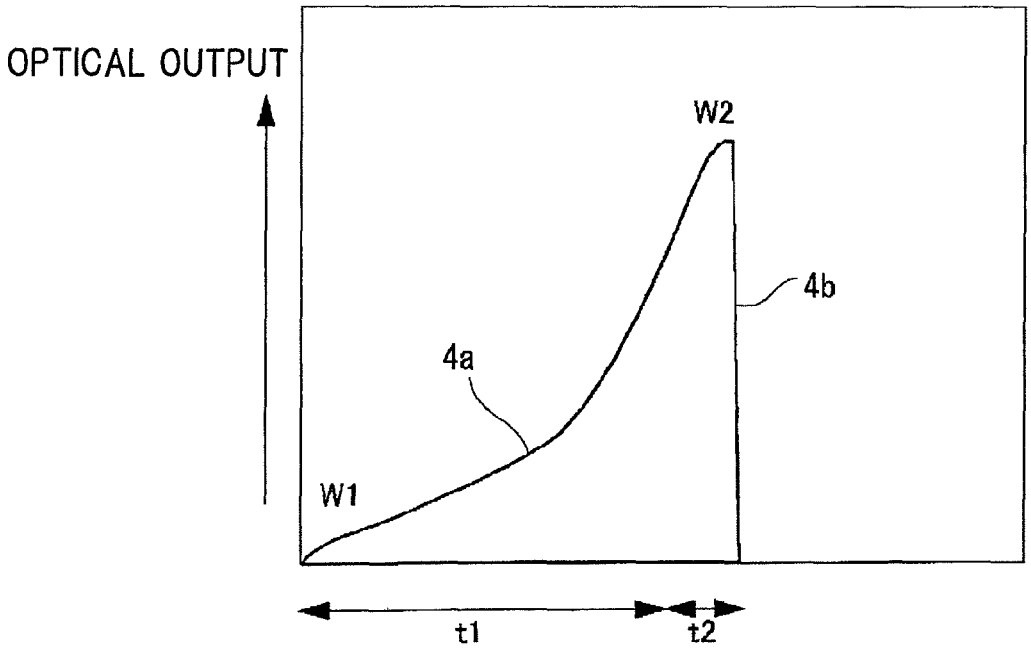
FIG. 12 is a graph showing relation between the optical outputs of the laser beams and the irradiation time in the areas corresponding to the first laser beam radiating part and the second laser beam radiating part, in the exemplary embodiments as shown in FIGS. 10 and 11.

In the exemplary embodiments as shown in FIGS. 10 and 11, relation between the optical outputs of the laser beams 4*a*, 4*b* and the irradiation times in the areas corresponding to the first laser beam radiating part 5 and the second laser beam radiating part 6 is shown in a graph in FIG. 12. In this case, the irradiation is conducted in such a manner that the optical output may be gradually increased, by continuously varying the optical outputs of the laser beams 4*a*, 4*b* with a lapse of the irradiation time.

(Image Forming Apparatus in Another Exemplary Embodiment)

Figure 13:
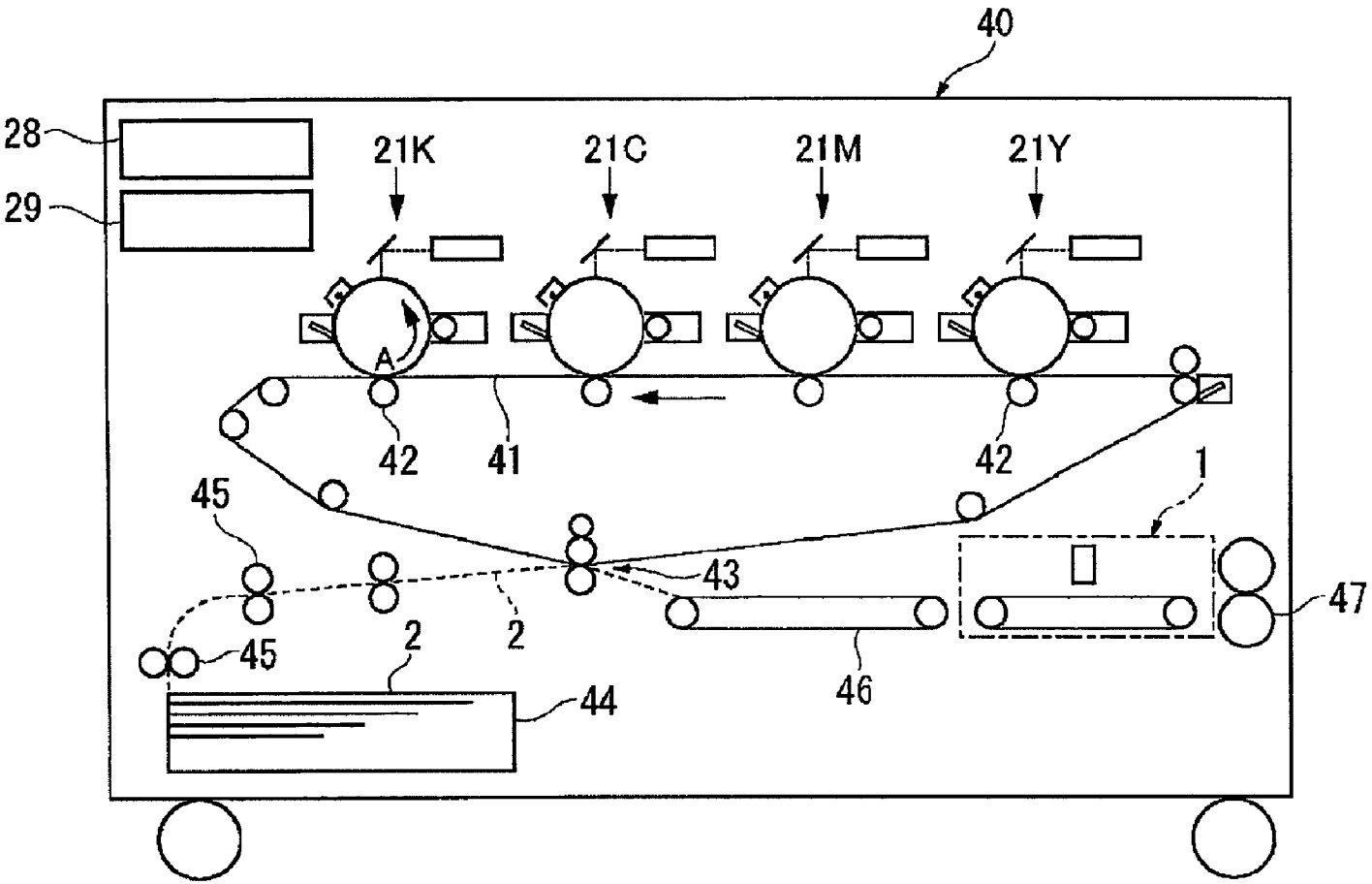
FIG. 13 is an explanatory view showing an entire structure of an image forming apparatus according to another exemplary embodiment.

FIG. 13 is an explanatory view showing an entire structure of an image forming apparatus according to another exemplary embodiment. In the image forming apparatus 20 as shown in FIG. 2, the continuous recording paper which has been wound around the core member or the continuous recording paper which has been folded to a predetermined size is used as the recording medium 2. However, the recording medium in the present invention is not limited to this. In the invention, sheet type recording paper which has been cut into a predetermined size such as an A4 size or B4 size may be used. As shown in FIG. 13, an image forming apparatus 40 according to this exemplary embodiment includes the image forming parts of four colors, for example, (the black image forming part 21K, the cyan image forming part 21C, the magenta image forming part 21M, and the yellow image forming part 21Y), a primary transferring device 42 for sequentially transferring the toner images of respective color components which have been formed in the image forming parts 21K, 21C, 21M, 21Y of the respective colors to an intermediate transferring belt 41, a secondary transferring device 43 for wholly transferring overlapped images which have been transferred to the intermediate transferring belt 41, to the recording medium 2, and the fixing device 1 for fixing the images which have been transferred by the secondary transferring device 43, on the recording medium 2.

In FIG. 13, reference numeral 44 represents a recording paper containing part which contains a plurality of the recording medium 2 in a form of the sheet type recording paper. Reference numeral 45 represents a conveying roll for taking out the recording medium 2 from the recording paper containing part 44 and conveying it, numeral 46 represents a conveying belt for conveying the recording medium 2 to the fixing device 1, after the image has been transferred by the secondary transferring device 43, and numeral 47 represents a discharge roll for discharging the recording medium 2 to the exterior, after the image has been fixed by the fixing device 1. Moreover, reference numeral 28 represents a control section for controlling the image forming parts 21K, 21C, 21M, 21Y of the respective colors, the primary transferring device 42, the secondary transferring device 43, and the fixing device 1. Reference numeral 29 represents an image processing section for carrying out the process for forming the image on the recording medium 2.

EXAMPLE

Now, the invention will be further specifically described referring to examples in which a prototype of the fixing device was produced, and experiments for fixing the toner image on the recording medium were made.

Example 1

As the image forming apparatus, "DucuColor 1256GA" (an electro-photographic apparatus), a product of Fuji Xerox Co., Ltd. was used. This image forming apparatus was loaded with a laser fixing toner as described below.

As this laser fixing toner, image forming material admixed with 0.5% of a pigment which remarkably absorbs a beam having a wavelength near 810 nm was used, so that the laser beam radiated for fixing may be absorbed. For example, the image forming material containing perimidine-based squarylium coloring matter was used. This image forming material has low light absorbency in a region of a wavelength from 400 nm to 750 nm of a visible light, and high light absorbency in a region of a wavelength from 750 nm to 1000 nm of a near-infrared ray.

As the fixing device 1, a fixing device 9001-80-808 (a wavelength of 808 nm, an optical output of 80 W), a product of Coherent Inc. which is provided with semiconductors in two rows (corresponding to FIG. 3) was used. Conveying speed of the recording medium 2 was 1000 mm/s.

In this state, one of the rows was used as the first laser beam radiating part 5, and an unfixed toner image on the recording medium 2 was irradiated with a laser beam which has a beam width of 10 mm in the lateral direction intersecting the conveying direction C of the recording medium 2 and a beam width of 10 mm in the direction along the conveying direction C. The other row was used as the second laser beam radiating part 6, and the recording medium 2 was irradiated with a laser beam which has a beam width of 10 mm in the lateral direction intersecting the conveying direction C of the recording medium 2 and a beam width of 2 mm in the direction along the conveying direction C.

Example 2

In Example 2, the same image forming apparatus and the same laser fixing toner as used in Example 1 were used, while a fixing device as described below was used, as the fixing device 1.

As this fixing device 1, the fixing device 9001-80-808 (a wavelength of 808 nm, a optical output of 80 W), the product of Coherent Inc. was used as a base. The fixing device is further provided with a row of semiconductor lasers of which the optical output is increased to 160 W, a half mirror for dividing the beam from the semiconductor lasers in two by penetrating a part of the beam and reflecting the other part sideward, and a total reflection mirror for reflecting the laser beam which has been reflected by the half mirror again to direct an optical path to the recording medium 2 (corresponding to FIG. 9). The conveying speed of the recording medium 2 was 1000 mm/s.

In this state, a system including the semiconductor lasers, the half mirror, and the total reflecting mirror was used as the first laser beam radiating part 5, and an unfixed toner image on the recording medium 2 was irradiated with a laser beam which has a beam width of 10 mm in the lateral direction intersecting the conveying direction C of the recording medium 2 and a beam width of 10 mm in the direction along the conveying direction C. Moreover, a system including the semiconductor lasers and the half mirror was used as the second laser beam radiating part 6, and the recording medium 2 was irradiated with a laser beam which has a beam width of 10 mm in the lateral direction intersecting the conveying direction C of the recording medium 2 and a beam width of 2 mm in the direction along the conveying direction C.

Example 3

In Example 3, the same image forming apparatus and the same laser fixing toner as used in Example 1 were used, while a fixing device as described below was used, as the fixing device 1.

As this fixing device 1, the fixing device 9001-80-808 (a wavelength of 808 nm, an optical output of 80 W), the product of Coherent Inc. was used as a base. The fixing device 1 is further provided with a row of semiconductor lasers of which the optical output is increased to 160 W, and an optical axis of the laser beam emitted from the semiconductor lasers was inclined by 45 degree to the downstream side in the conveying direction C of the recording medium 2 (corresponding to FIG. 10). The conveying speed of the recording medium was 1000 mm/s.

In this state, the unfixed toner image on the recording medium 2 was irradiated with the laser beam which has the beam width of 10 mm in the lateral direction intersecting the conveying direction C of the recording medium 2.

Comparative Example 1

In Comparative Example 1, the same image forming apparatus and the same laser fixing toner as used in Example 1 were used, while a fixing device as described below was used.

As this fixing device, a fixing device provided with a row of semiconductor lasers corresponding to the first laser beam radiating part 5 in the fixing device 1 in Example 1 was used. Then, an unfixed toner image on the recording medium 2 was irradiated with the laser beam which has a beam width of 10 mm in the lateral direction intersecting the conveying direction C of the recording medium and a beam width of 10 mm in the direction along the conveying direction C.

Comparative Example 2

In Comparative Example 2, the same image forming apparatus and the same laser fixing toner as used in Example 1 were used, while a fixing device as described below was used.

As this fixing device, a fixing device provided with a row of semiconductor lasers corresponding to the second laser beam radiating part 6 in the fixing device 1 in Example 1 was used. Then, an unfixed toner image on the recording medium 2 was irradiated with the laser beam which has a beam width of 10 mm in the lateral direction intersecting the conveying direction C of the recording medium and a beam width of 2 mm in the direction along the conveying direction C.

Evaluation of Examples and Comparative Examples

Fixing performances of the images (the toner images) with respect to the recording medium 2 which have been obtained in Examples 1, 2, 3 and Comparative Examples 1, 2 are evaluated, and the results of the evaluation are shown in a table in FIG. 14. A method and criteria of the evaluation as shown in FIG. 14 are as follows.

Firstly, with respect to the area of the toner image having the high image density in the recording medium 2, the recording paper was double-folded at a certain position in the area having the image, and the evaluation was made as to whether or not the image (the toner image) has peeled off from the recording paper.

o: the image (the toner image) has not peeled off.

x: the image (the toner image) has peeled off.

Secondly, with respect to the area of the toner image having the low image density in the recording medium 2, the area was observed through a microscope to find a position where only one or a few toner particles exist. Then, the toner image having the low image density was rubbed with a cotton bud, for example, and the evaluation was made as to whether or not the image has peeled off from the recording paper.

o: the toner image having the low image density has not peeled off.

x: the toner image having the low image density has peeled off.

Further, occurrence of a defective image called as "a void" which occurs when temperature of the toner becomes too high with irradiation of the laser beam in the area having the high image density was evaluated by visually observation.

o: the defective image has not occurred.

x: the defective image has occurred.

Results of the Evaluation

The results of the evaluations on the fixing performance which have been made according to the above described evaluation method and evaluation criteria are shown in the table in FIG. 14.

In Example 1, the toner image has not peeled off in both the area having the high image density and the area having the low image density. The defective image too has not occurred.

In Example 2, the toner image has not peeled off in both the area having the high image density and the area having the low image density. The defective image too has not occurred.

In Example 3, the toner image has not peeled off in both the area having the high image density and the area having the low image density. The defective image too has not occurred.

In Comparative Example 1, the toner image has not peeled off and the defective image has not occurred in the area having the high image density. However, the toner image has peeled off in the area having the low image density.

In Comparative Example 2, the toner image has not peeled off in both the area having the high image density and the area having the low image density. However, the defective image has occurred in the area having the high image density.

The foregoing description of the exemplary embodiment of the present invention has been provided for the purpose of illustration and description. It is not intended to be exhaustive or to limit the invention to the precise forms disclosed. Obviously, many modifications and various will be apparent to practitioners skilled in the art. The exemplary embodiments were chosen and described in order to best explain the principles of the invention and its practical application, thereby enabling other skilled in the art to understand the invention for various embodiments and with the various modifications as are suited to the particular use contemplated. It is intended that the scope of the invention be defined by the following claims and their equivalents.

What is claimed is:

1. A fixing device comprising:

a first laser unit that outputs a first laser beam so as to irradiate a visible image formed of image forming material on a recording medium with the first laser beam; and a second laser unit that outputs a second laser beam so as to irradiate the visible image with the second laser beam after being irradiated with the first laser beam, wherein the first laser beam and the second laser beam is configured to satisfy relations: $W1<W2$ and $t1>t2$, W1 is an optical output per unit area of the first laser beam, W2 is an optical output per unit area of the second laser beam, t1 is an irradiation time per unit area of the first laser beam, t2 is an irradiation time per unit area of the second laser beam, and the visible image is fixed on the recording medium by the first laser beam and the second laser beam with the relations, wherein the image forming material in a first area having high image density of the visible image is fixed to the recording medium by the irradiation of the first laser beam, wherein the image forming material in a second area having low image density of the visible image is not fixed to the recording medium by the irradiation of the first laser beam, and wherein the image forming material in the second area having low image density of the visible image is fixed to the recording medium by the irradiation of the second laser beam.

2. The fixing device according to claim 1, wherein an area, where the visible image is not formed on the recording medium, is irradiated with the second laser beam.

3. An image forming apparatus comprising:

an image forming device that forms a visible image formed of image forming material on a recording medium, and a fixing device includes:

a first laser unit that outputs a first laser beam so as to irradiate the visible image with the first laser beam; and a second laser unit that outputs a second laser beam so as to irradiate the visible image with the second laser beam after being irradiated with the first laser beam, wherein the first laser beam and the second laser beam is configured to satisfy relations: $W1<W2$ and $t1>t2$, W1 is an optical output per unit area of the first laser beam, W2 is an optical output per unit area of the second laser beam, t1 is an irradiation time per unit area of the first laser beam, t2 is an irradiation time per unit area of the second laser beam, and the visible image is fixed on the recording medium by the first laser beam and the second laser beam with the relations, wherein the image forming material in a first area having high image density of the visible image is fixed to the recording medium by the irradiation of the first laser beam, wherein the image forming material in a second area having low image density of the visible image is not fixed to the recording medium by the irradiation of the first laser beam, and wherein the image forming material in the second area having low image density of the visible image is fixed to the recording medium by the irradiation of the second laser beam.

4. The image forming apparatus according to claim 3, wherein an area, where the visible image is not formed on the recording medium, is irradiated with the second laser beam.

5. A fixing method for fixing a visible image formed of image forming material on a recording medium, the method comprising:

irradiating the visible image with a first laser beam; and irradiating the visible image with a second laser beam after the irradiating the visible image with the first laser beam, wherein the first laser beam and the second laser beam is configured to satisfy relations: $W1<W2$ and $t1>t2$, W1 is an optical output per unit area of the first laser beam, W2 is an optical output per unit area of the second laser beam, t1 is an irradiation time per unit area of the first laser beam, and t2 is an irradiation time per unit area of the second laser beam, wherein the image forming material in a first area having high image density of the visible image is fixed to the recording medium by the irradiation of the first laser beam, wherein the image forming material in a second area having low image density of the visible image is not fixed to the recording medium by the irradiation of the first laser beam, and wherein the image forming material in the second area having low image density of the visible image is fixed to the recording medium by the irradiation of the second laser beam.

6. The fixing method according to claim 5, wherein an area, where the visible image is not formed on the recording medium, is irradiated with the second laser beam.

* * * * *